United States Patent [19]

Kelley et al.

[11] Patent Number: 4,661,784

[45] Date of Patent: Apr. 28, 1987

[54] KLYSTRON HAVING FIXED AND VARIABLE TUNING MECHANISMS

[75] Inventors: Arthur W. Kelley, Sudbury; Charles J. Larsen, South Sudbury, both of Mass.

[73] Assignee: Raytheon Company, Lexington, Mass.

[21] Appl. No.: 252,965

[22] Filed: Apr. 10, 1981

Related U.S. Application Data

[63] Continuation of Ser. No. 52,390, Jun. 27, 1979, abandoned.

[51] Int. Cl.[4] ..... H01J 25/10

[52] U.S. Cl. ..... 331/83; 315/5.48; 315/5.53

[58] Field of Search ..... 331/79, 83, 84; 315/5.46, 5.48, 5.53, 5.54; 330/45

[56] References Cited

U.S. PATENT DOCUMENTS

| | | | |
|---|---|---|---|
| 3,078,385 | 2/1963 | Sorg et al. | 315/5.48 |
| 3,097,323 | 7/1963 | Salisbury | 315/5.48 |
| 3,117,251 | 1/1964 | DePue, Jr. et al. | 315/5.48 |

*Primary Examiner*—Edward P. Westin

*Attorney, Agent, or Firm*—Martin M. Santa; Richard M. Sharkansky

[57] ABSTRACT

A tuning structure for a klystron oscillator is provided by a set of holes extending part way through cavity walls of the klystron. The holes provide weakened portions in the cavity walls which permit an inward depression of the walls at the sites of the weakened portions for adjustment of the central frequency of an oscillation band. Thereby, deformable tuning diaphragms, which are employed for altering the oscillation frequency within the oscillation band, need not be deformed for an oscillation at the center of the desired band. Variations in frequency can thereby be accomplished without metal fatigue, such fatigue having occurred when the diaphragm has been utilized for setting the central frequency of the oscillation band.

5 Claims, 5 Drawing Figures

KLYSTRON HAVING FIXED AND VARIABLE TUNING MECHANISMS

CROSS-REFERENCE TO RELATED CASES

This is a continuation of application Ser. No. 52,390, filed June 27, 1979, now abandoned.

BACKGROUND OF THE INVENTION

This invention relates to klystrons and, more particularly, to the tuning of klystron oscillators.

Multiple cavity klystron oscillators are employed for the generation of carrier signals at microwave frequencies, for example, at X band. In order to select a specific frequency of oscillation, it has often been the practice to provide a diaphragm in a wall of each of the cavities, the diaphragm being deformable so that the frequency may be raised by pressing the diaphragm inwardly to decrease the volume of a cavity, the frequency being lowered by pulling the diaphragm outwardly to increase the volume of the cavity. The cavity walls are typically made of copper of sufficient thickness to maintain dimensional stability while the diaphragms are made substantially thinner than the walls and brazed thereto for a vacuum tight seal.

A problem arises in that in the commercial production of klystron oscillators, the central frequency of the tuning band is desirably set at different values for different applications of the klystron. To accomplish the selection of the center frequency of the tuning band, it has been the practice to prestress the tuning diaphragm, as by a tuning screw attached to the klystron outside the cavity. Thereupon, the diaphragm may be further deformed to accomplish the desired tuning within the tuning range. However, it is noted that the diaphragm is thereby utilized both for establishing a bias frequency as well as for the range of frequencies about the center of the tuning band. As a result, the combination of deformation employed for the initial adjustment as well as for the subsequent tuning has produced premature fatigue in the material of which the diaphragm is fabricated. Accordingly, the total number of tuning operations for selecting a desired frequency is significantly limited.

SUMMARY OF THE INVENTION

The aforementioned problem is overcome and other advantages are provided by a klystron having one or more cavities bounded by rigid cavity walls and wherein, in accordance with the invention, one or more of the walls of each of the cavities are provided with a weakened portion formed by a hole which extends part way through the cavity wall. The invention provides for the establishing of the center frequency of the tuning band by initially constructing enlarged cavities for oscillation at a frequency somewhat lower than that of the center frequency of the band. The volume of each cavity is then reduced by a compression of the cavity structure at the weakened portions of the walls resulting in an inward deflection of a small region of the compressed walls which raises the frequency of oscillation to the desired value. Thereupon, tuning diaphragms located within a wall of each of the cavities may be depressed inwardly or outwardly through a relatively small deformation to accomplish a tuning of the klystron at frequencies within the tuning band both above and below the preselected frequency.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
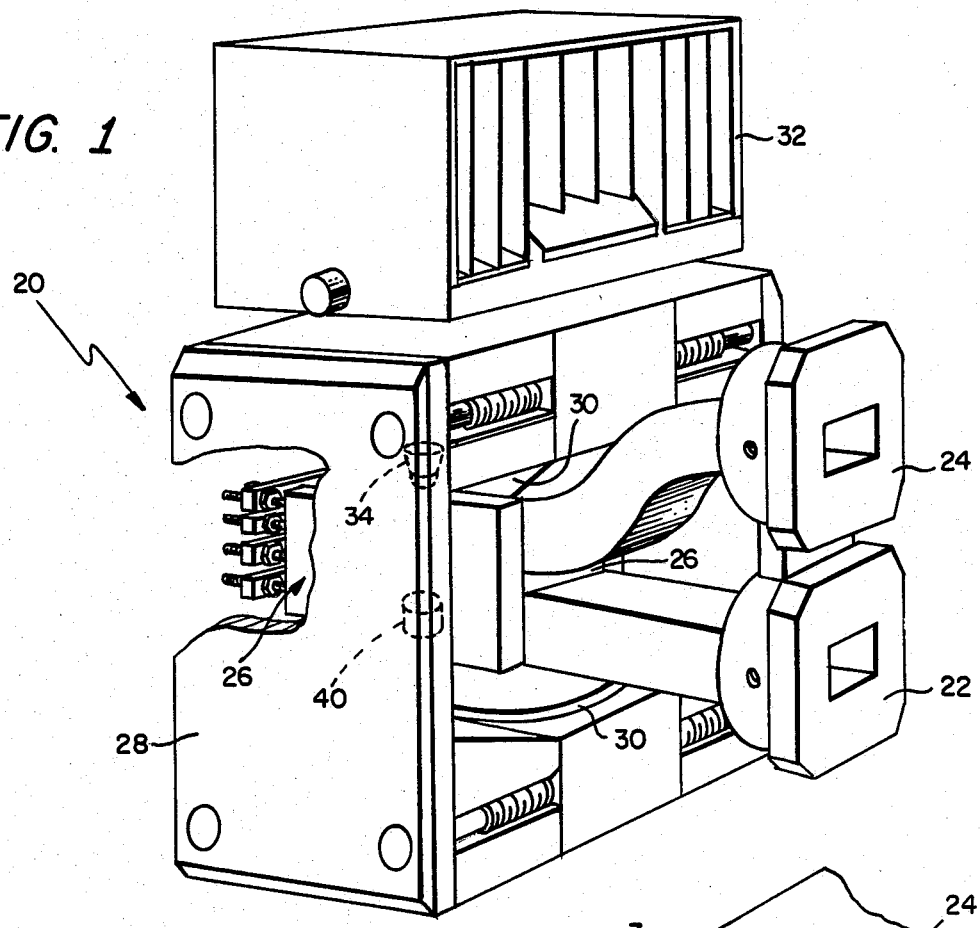
FIG. 1 is a pictorial view of a multiple cavity klystron amplifier incorporating the invention, a portion of the klystron being cut away to facilitate a viewing of components thereof.

Referring now to FIGS. 1–4, the pictorial view of FIG. 1 shows a multiple cavity klystron 20 incorporating the tuning structure of the invention. The klystron 20 is utilized as an amplifier and, accordingly, includes an input waveguide 22 and an output waveguide 24 which are coupled to respective ends of a cavity assembly 26. The klystron 20 includes a magnet 28 having pole pieces 30 located at opposite ends of the cavity assembly 26 for focussing a beam of radiation therethrough. A cooling assembly 32 is seen situated above the output waveguide 24 for extracting heat dissipated within a collector 34 partially seen in a phantom view above the cavity assembly 26. A portion of a tuning screw assembly 36 for tuning the respective cavities 38 of the cavity assembly 26 is partially seen through a cutaway portion of the magnet 28.

The klystron 20 further comprises a cathode assembly 40 which is understood to include focussing electrodes (not shown), and an anode 42 positioned between the cathode assembly 40 and the cavity assembly 26 for directing an electron beam through a drift region 44 of the cavity assembly 26. An input signal incident at the input waveguide 22 is applied to a first cavity 38 of the cavity assembly 26 whereupon it interacts with the electron beam to extract power therefrom for amplification of the signal. The amplified signal is extracted from the last cavity 38 of the cavity assembly 26 via the output waveguide 24. The waveguides 22 and 24 are coupled via well known irises 45 to their respective cavities 38. The collector 34 is seen located adjacent the end of the cavity assembly 26, opposite the cathode assembly 40, for dissipating power remaining in the electron beam.

Figure 3:
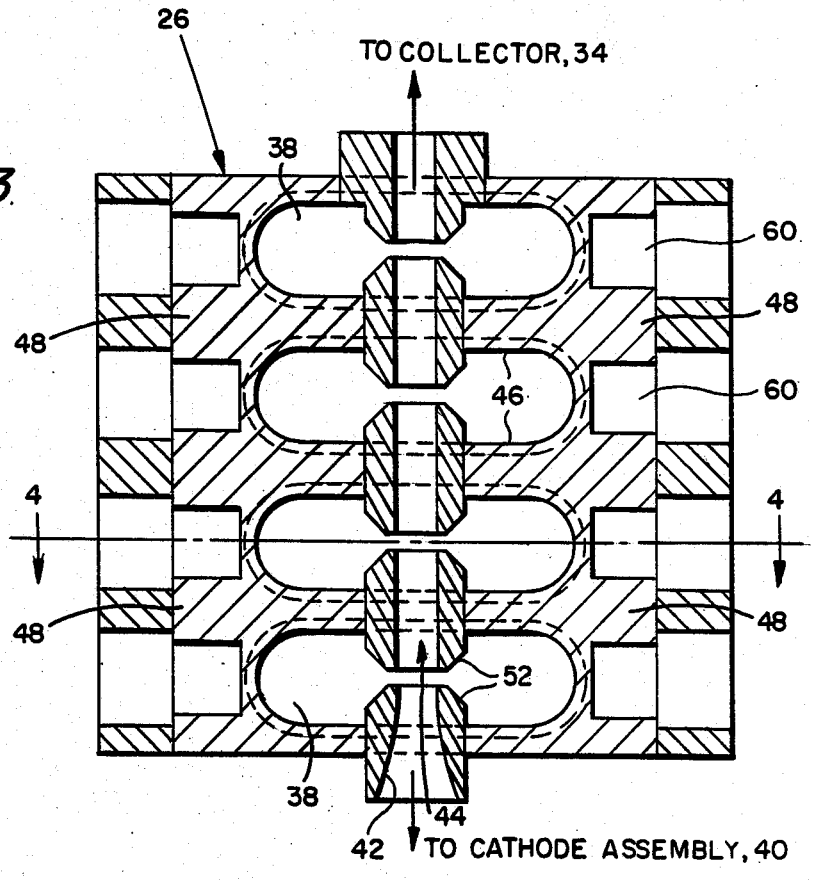
FIG. 3 shows a sectional view of the cavity structure of the klystron taken along the line 3—3 of FIG. 2, FIG. 3 also showing the partially penetrating holes in the cavity walls for tuning the klystron in accordance with the invention.
Figure 4:
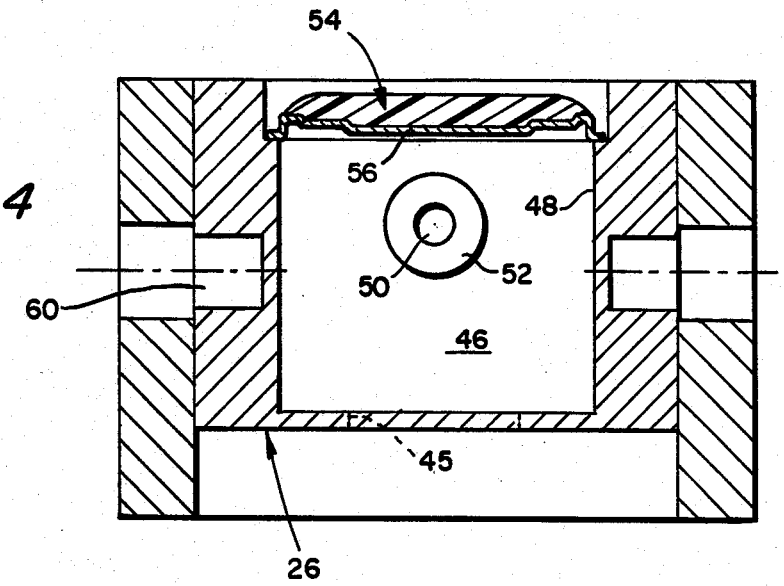
FIG. 4 shows a further sectional view of the cavity structure taken along the line 4—4 of FIG. 3.

As seen in FIGS. 3 and 4, the cavity assembly 26 is composed of an exemplary set of four reentrant cavities 38 separated by relatively thin walls 46 which are rigidly secured to a pair of side walls 48 of increased thickness which retain a rigid format to the cavity assembly 26. Apertures 50 having surrounding conical lips 52 with a gap spacing are provided within the walls 46 separating the cavities 38, the apertures 50 being aligned with the electron beam to provide for the drift region 44 wherein the beam interacts with stored energy within each of the cavities 38. The dimensions of the cavities 38 provide for a resonance of the stored electromagnetic energy at the operating frequency band of the klystron 20. The four cavities 38 are individually tuned to different parts of the band to provide the desired band pass characteristic for signals amplified by the klystron 20. The tuning is accomplished by means of deformable diaphragms 54 positioned within respective ones of the cavities 38 and being sealed to the cavity walls as by brazing. The diaphragms 54 are formed of a monel base clad with a layer 56 of copper on the side facing the interior of a cavity 38. The diaphragms 54 are mechanically coupled to the tuning screw assembly 36 whereby, by a turning of individual ones of the tuning screws 58, the diaphragms 54 are urged inwardly towards the central portion of the respective cavities 38, or, alternatively, are urged away from the central portion of the respective cavities 38. Thereby, the enclosed volume of respective ones of the cavities 38 may be decreased or increased, respectively, for increasing or decreasing the resonant frequency of the respective cavities 38.

In accordance with the invention, the thick side walls 48 of the cavities 38 are formed of an electrically conductive, deformable material, such as soft copper, and are provided with holes 60 extending partly through the side walls 48 to provide for weakened portions of the side walls 48 which permit a deformation of each weakened portion to accomplish a decreasing of the volumes enclosed by respective ones of the cavities 38. Thereby, the cavities 38 are initially constructed with a volume slightly greater than that required for the anticipated frequency range of operation of the klystron and, thereafter, the relatively thin weakened portion of the side walls 48 at the bases of the respective holes 60 are compressed inwardly, as will be described with reference to FIG. 5, to permanently decrease the enclosed volume and to provide a fixed and irreversible increase of the frequency of operation to the mid-band frequency of the anticipated range of operation.

Figure 5:
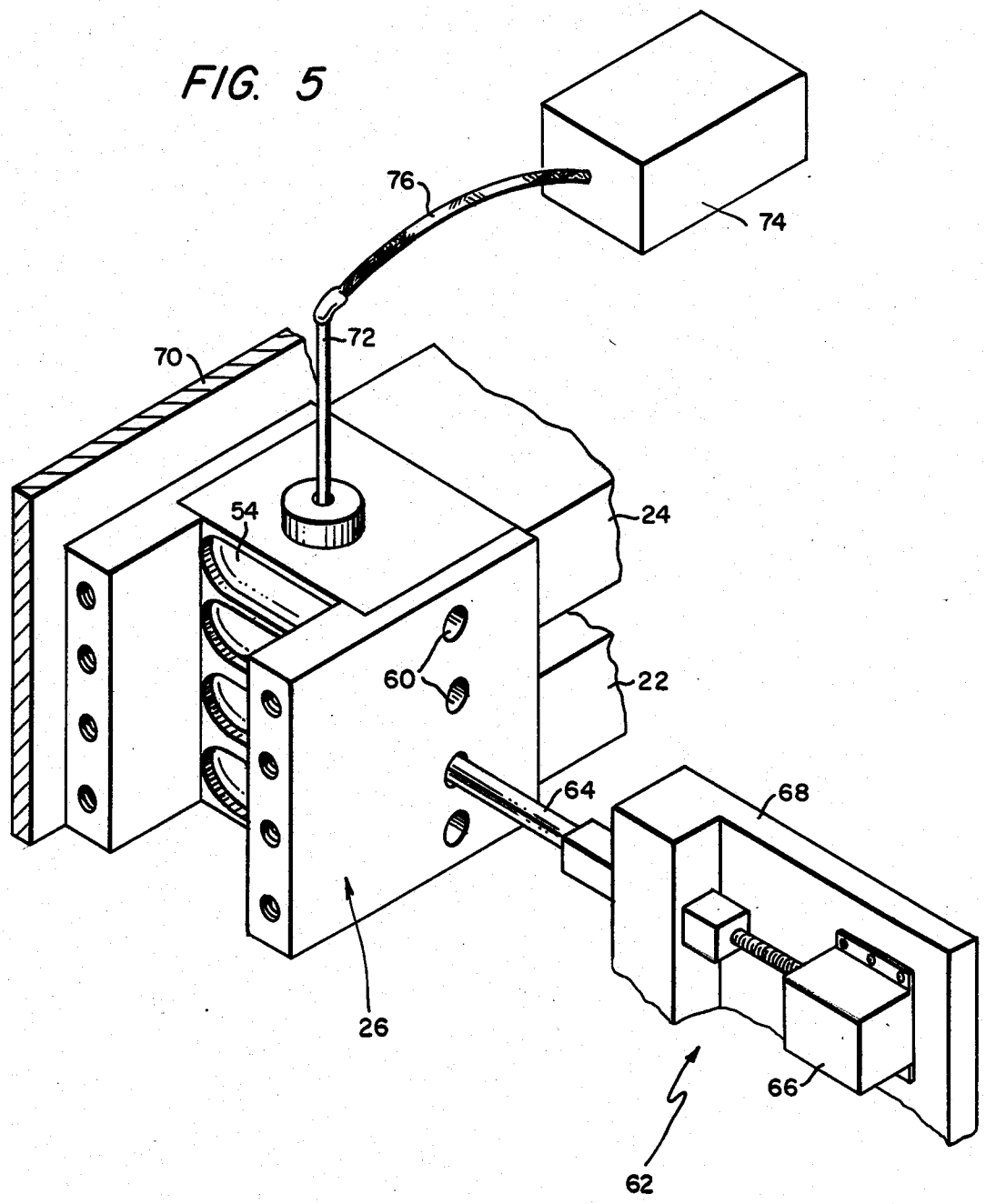
FIG. 5 shows a diagrammatic view of a punch assembly for punching the holes of the cavity walls inwardly while a frequency measurement is performed on the klystron.

With reference also to FIG. 5, there is seen a diagrammatic view of a punch assembly 62 incorporating a plunger 64 having a hemispherical end which is inserted sequentially into the respective holes 60, the plunger 64 being advanced by a drive unit 66 to deform the side wall 48 for setting the frequency of each of the cavities 38. As the plunger 64 slides through a frame 68, which positions the plunger 64 and the drive unit 66, a fixed support 70 holds the cavity assembly 26 stationary. As seen in FIG. 5, a test signal is applied via an antenna probe 72 inserted into a cavity 38 via the drift region 44, and a frequency measurement display 74 is coupled via a cable 76 to the probe 72 whereby the resonant frequency of the cavities 38 may be seen as a function of their individual tuning. After the cavities 38 have been permanently preset to their desired fixed and irreversible frequencies by means of the plunger 64 which is forced against the weakened portions of the side walls 48, the diaphragms 54 are them employed during normal operation of the klystron 20 for tuning the klystron 20 to a specific value of frequency in a range centered at the preset mid-band frequency.

Figure 2:
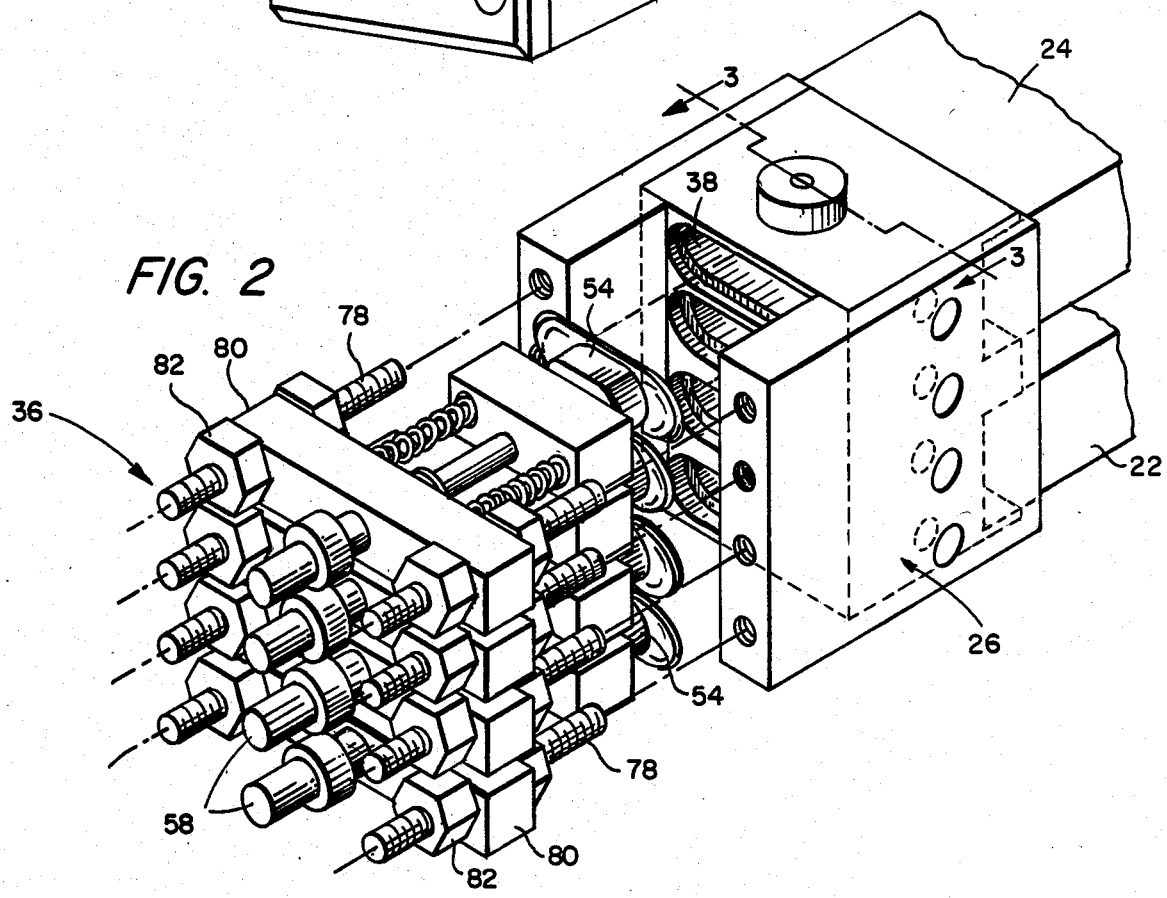
FIG. 2 shows an isometric view of the klystron of FIG. 1 with the magnet and heat sink of FIG. 1 as well as collector and cathode assemblies thereof being deleted, and a tuning screw assembly of FIG. 1 being shown in partly stylized and in exploded view to expose the tuning diaphragms of the klystron.

The tuning screw assembly 36 of FIG. 2 is seen to comprise a separate subsection for each of the cavities 38, each subsection being formed of screws 78, a bar 80, lock nuts 82, and the tuning screw 58. Turning of the tuning screw 58 advances or retracts the connecting linkage with the respective diaphragm 54 to distort the diaphragm 54 for decreasing or increasing, respectively, the enclosed volume of the cavity 38. In view of the initial setting of the frequency by means of the plunger 64, the resultant deformation of the diaphragms 54 for selecting frequencies of operation of the klystron 20 is relativey small so that substantially no fatigue in the material of the diaphragm 54 is introduced by the tuning operation.

It is understood that the above described embodiment of the invention is illustrative only and that modifications thereof may occur to those skilled in the art. Accordingly, it is desired that this invention is not to be limited to the embodiment disclosed herein but is to be limited only as defined by the appended claims.

What is claimed is:

1. A klystron comprising:

an electron beam;

a cavity bounded by a set of walls, two opposite walls of said set of walls each having an aperture aligned with each other to allow said beam to enter and exit said cavity;

one of said walls parallel to said beam comprising a reversibly deformable diaphragm, and a different one of said walls parallel to said beam having a partially penetrating hole to reduce the thickness of said different wall at the bottom of said hole for the admission of a plunger into said hole to permanently deform the wall at the bottom of said hole to reduce the volume of said cavity and hence the frequency of said klystron is altered to provide fixed tuning, the deformable diaphragm reversibly deforming the wall of the cavity of which it forms a part to reversibly tune the klystron about its fixed tuned frequency.

2. A klystron tuning assembly comprising:

a set of cavities arranged along a drift region of a klystron, said cavities being bounded by relatively thick walls oriented parallel to the common axis of said drift region and said cavities, adjacent ones of said cavities being separated by relatively thin walls;

at least one of said thick walls parallel to said axis of each of said cavities being provided with a deformable diaphragm for reversibly tuning said cavities to a desired frequency within a tuning range by changing the volume of each of said cavities; and yield points within different ones of said thick walls corresponding to respective ones of said cavities, each of said yield points being the remaining portion of said thick wall created by a partially penetrating hole within at least one of said different thick walls of each cavity, a yield point of said wall yielding under the force of a probe inserted into said hole to permanently deform said wall to reduce the size of a cavity for irreversibly setting the center frequency of said tuning range.

3. The klystron tuning assembly of claim 2 wherein:

said drift region comprises drift tubes having axial gaps within each of said cavities, said axial gaps being unchanged in axial dimension upon permanent deformation of the yield points of said walls of each cavity.

4. The klystron of claim 2 wherein said drift region comprises:

a pair of drift tubes penetrating and attached to said opposite thin walls;

each pair of said drift tubes of a cavity being longitudinally separated along said axis at their respective ends within said cavity to provide a gap between said tube ends within said cavity to form a reentrant type cavity;

said deformations of said yield points of said thick walls not changing the gap within said reentrant cavity.

5. A method of tuning a klystron comprising:

partially perforating a wall of a cavity of said klystron;

forcing the partially perforated portion of said wall inwardly into said cavity to permanently reduce the volume of said cavity and thereby tune said klystron to its approximate operating frequency;

applying a force to a diaphragm forming a portion of a different wall of said cavity to reversibly change the volume of said cavity to reversibly select a desired frequency of operation around said approximate operating frequency;

said klystron having an electron beam;

said cavity of said klystron has a reentrant portion having a relativley closely spaced gap within said reentrant portion of said cavity through which said electron beam passes through said cavity; and said change in the volume of said cavity being accomplished without changing the gap within said cavity.

* * * * *